United States Patent [19]

Matsumura et al.

[11] Patent Number: 4,859,558

[45] Date of Patent: Aug. 22, 1989

[54] COMPOSITION WITH FATTY ACID BISAMIDE POWDER DEVELOPER

[75] Inventors: Yasuo Matsumura; Takayoshi Aoki; Masayuki Takeda; Chiaki Suzuki; Ikutaroh Nagatsuka, all of Kanagawa, Japan

[73] Assignee: Fuji Xerox Co., Ltd., Tokyo, Japan

[21] Appl. No.: 143,881

[22] Filed: Jan. 14, 1988

[30] Foreign Application Priority Data

Jan. 14, 1987 [JP] Japan ..... 62-5005

[51] Int. Cl.[4] ..... G03G 9/10; G03G 13/08

[52] U.S. Cl. ..... 430/110; 430/125

[58] Field of Search ..... 430/110, 125

[56] References Cited

U.S. PATENT DOCUMENTS

| | | | |
|---|---|---|---|
| 3,951,835 | 4/1976 | Tomono et al. | 430/110 X |
| 4,072,521 | 2/1978 | Scouten et al. | 430/125 X |
| 4,073,649 | 2/1978 | Scouten et al. | 430/125 |
| 4,076,641 | 2/1978 | Scouten et al. | 430/125 X |
| 4,099,968 | 7/1978 | Scouten et al. | 430/110 X |
| 4,643,960 | 2/1987 | Quan | 430/110 X |

FOREIGN PATENT DOCUMENTS

| | | | |
|---|---|---|---|
| 2406192 | 8/1974 | Fed. Rep. of Germany | 430/110 |
| 60-163050 | 8/1945 | Japan | 430/110 |

*Primary Examiner*—Paul R. Michl
*Assistant Examiner*—Jeffrey A. Lindeman
*Attorney, Agent, or Firm*—Sughrue, Mion, Zinn, Macpeak & Seas

[57] ABSTRACT

A toner composition for a two-component type developer capable of developing electrostatically charged images formed on a photoreceptor having a surface layer comprising organic substances, wherein the toner composition contains a fatty acid bisamide compound as an external additive.

5 Claims, No Drawings

COMPOSITION WITH FATTY ACID BISAMIDE POWDER DEVELOPER

FIELD OF THE INVENTION

The present invention relates to a dry toner composition for a two-component type developer capable of developing electrostatically charged images in electrophotographic image-forming methods and electrostatic recording methods.

BACKGROUND OF THE INVENTION

In electrophotography, an image copy can be obtained by developing electrostatically charged images formed on a photoreceptor with resin powders generally containing pigments (hereinafter "toners") to visualize the images and transferring the visual images onto a duplicating paper, followed by fixing the resulting images thereon. The photoreceptor is, thereafter, required to undergo cleaning before forming electrostatically charged images again. Such a cleaning process is important, because incomplete and ineffective cleaning will often lead to deterioration of images over time.

Therefore, many approaches have been proposed to facilitate the cleaning process, such as a method which comprises preventing toners from adherence to the photoreceptor by providing lubricating agents on the surface of a photoreceptor, a method which comprises adding inorganic fine particles such as silica or alumina in toners themselves to prevent toners from direct contact with the photoreceptor, a method which comprises preventing toners from adherence by suitably abrading the photoreceptor or a method which comprises adding lubricating agents of metal salts of a fatty acid to toners externally.

However, when inorganic fine particles are added to toners and the surface layer of a photoreceptor is composed of organic substances, the surface of the photoreceptor is likely to cave or to be scratched by hard inorganic fine powders, and the abrasive effects obtained when a surface layer of a photoreceptor is composed of inorganic substances cannot be obtained. Therefore, toners are liable to partially adhere at the scratched areas. Further, even when toners are not firmly adhered to the photoreceptor surface, cleaning effects are likely to decrease with the passage of time, leading to the deterioration of images. Such a decrease of cleaning effects is particularly prominent when a two-component type developer using hard carriers is used. cl SUMMARY OF THE INVENTION An object of the present invention is to solve the above described problems.

That is, a first object of the present invention is to provide a toner composition capable of developing electrostatically charged images which hardly adhere on the surface of a photoreceptor comprising organic substances.

A second object of the present invention is to provide a toner composition for a two-component type developer which can be easily and uniformly cleaned from the photoreceptor surface layer comprising organic substances without causing deterioration of images.

A third object of the present invention is to provide a toner composition for a two-component type developer which does not cause deterioration of a photoreceptor having a surface layer comprising organic substances.

The above and other objects of the present invention can be attained by adding a powder of a fatty acid bisamide compound to the toners as an external additive.

DETAILED DESCRIPTION OF THE INVENTION

Providing lubricating agents on the surface of a photoreceptor in order may be effective in preventing damage to the photoreceptor caused by inorganic fine powders and carriers, e.g., the occurrence of undesirable surface scratches may be decreased or prevented. In such cases, toners hardly adhere to the photoreceptor surface and can undergo uniform cleaning. However, such desired improvements cannot always be obtained. For example, by selecting inappropriate lubricating agents, deterioration of images (such as due to fog formation) is liable to occur. Accordingly, suitable lubricating agents must be selected depending upon the situation and materials to be employed.

Fatty acid bisamides have comparatively high melting points among amide type waxes. Therefore, in accordance with the present invention, when a fatty acid bisamide is added to a toner externally in an electrostatic system using a photoreceptor having an organic surface layer, white spots on resulting images and fog formation hardly occur. The fatty acid bisamide acts as a lubricating film. Further, when a fatty acid bisamide is used in a two-component type developer as herein, it exhibits excellent charging stability with the passage of time and deterioration of the carrier hardly occurs.

The additive amount of the fatty acid bisamide powder is generally from about 0.01 to about 1% by weight, preferably from 0.05 to 0.5% by weight based on the weight of the toner. The fatty acid bisamide powder is generally smaller in size than the toner.

The fatty acid bisamide powder may be added externally to the toner by various methods, and a direct mixing method using a V-type mixing device or a Henschel mixer is simple and effective.

Suitable fatty acid bisamides include all bisamides of saturated fatty acids, unsaturated fatty acids and aromatic fatty acids, and those having a melting point of 50° C. or higher are preferred. Specific examples thereof include, for example, ethylene bisoleic acid amide, ethylene bisbehenic acid amide, ethylene bisstearic acid amide, ethylene bislauric acid amide, methylene bisstearic acid amide, hexamethylene bisoleic acid amide, butylene bisstearic acid amide, hexamethylene bisstearic acid amide, N,N'-dioleylsebacic acid amide, N,N'-dioleyladipic acid amide, N,N'-distearyl sebacic acid amide, N,N'-distearyladipic acid amide, m-xylylene bisstearic acid amide, N,N'-distearyl isophthalic acid amide, N,N'-distearyl terephthalic acid amide and the like. Of these, ethylene bisoleic acid amide, ethylene bisbehenic acid amide, ethylene bisstearic acid amide, ethylene bislauric acid amide, methylene bisstearic acid amide, hexamethylene bisoleic acid amide, butylene bisstearic acid amide and hexamethylene bisstearic acid amide, are particularly preferred.

Toners which can be used in the present invention are those comprising a mixture of carbon black or other coloring agents and various known resinous binders such as a styrene-acryle type, a polyester type, a styrene-butadiene type, an olefin type, a polyamide type, an epoxy type or a ketone type, which may also contain magnetic particles.

In more detail, any suitable vinyl resin having a melting point of at least about 110° F. may be employed as the binder. The vinyl resin may be a homopolymer or a copolymer of two or more vinyl monomers. Typical monomeric units which may be employed to form vinyl polymers include: styrene, p-chlorostyrene, vinyl naphthalene; ethylenically unsaturated monoolefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of α-methylene aliphatic monocarboxylic acids such as methyl acrylate, ethyl acrylate, n-butylacrylate, chloroethyl acrylate, phenyl acrylate, methyl α-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidine and the like, and mixtures thereof. Generally, suitable vinyl resins employed in the toner have a weight average molecular weight between about 3,000 to about 500,000.

Binders containing relatively high percentages of a styrene resin are preferred. The presence of a styrene resin is preferred because a greater degree of image definition is generally achieved upon latent image development. Further, denser images are obtained when at least about 25% by weight, based on the total weight of resin in the toner, of a styrene resin is present in the toner. The styrene resin may be a homopolymer of styrene or styrene homologues or copolymers of styrene with other monomeric groups containing a single methylene group attached to a carbon atom by a double bond. Thus, typical monomeric materials which may be copolymerized with styrene by addition polymerization include: p-chlorostyrene, vinyl naphthalene, ethylenically unsaturated monoolefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of α-methylene aliphatic monocarboxylic acids such as methyl acrylate, ethyl acrylate, n-butyl acrylate, isobutyl acrylate, dodecyl acrylate, n-octyl acrylate, 2chloroethyl acrylate, phenyl acrylate, methyl α-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidine and the like; and mixtures thereof. The styrene resins may also be formed by the polymerization of mixtures of two or more of these unsaturated monomeric materials with a styrene monomer. The expression "addition polymerization" is intended to include known polymerization techniques such as free radical, anionic and cationic polymerization processes.

The vinyl resins, including styrene type resins, may also be blended with one or more other resins if desired. When the vinyl resins is blended with another resin, the added resin is preferably another vinyl resin because the resulting blend is characterized by especially good triboelectric stability and uniform resistance against physical degradation. The vinyl resins employed for blending with the styrene type or other vinyl resin may be prepared by the addition polymerization of any suitable vinyl monomer such as the vinyl monomers described above. Other thermoplastic resins may also be blended with the vinyl resins of this invention. Typical non-vinyl type thermoplastic resins include: rosin-modified phenol-formaldehyde resins, oil-modified epoxy resins, polyurethane resins, cellulosic resins, polyether resins and mixtures thereof. When the resin component of the toner contains styrene copolymerization with another unsaturated monomer or a blend of polystyrene and another resin, a styrene component of at least about 25% by weight based on the total weight of the resin present in the toner is preferred because denser images are obtained and a greater degree of image definition is achieved with a given quantity of toner material.

It is to be understood that the resins of the toner do not exclude the presence of monomeric units or reactants other than those which have been described. For example, some commercial materials contain trace amounts of homologues or unreacted or partially reacted monomers. Any minor amount of such substituents may be present in the toner of this invention.

Any suitable pigment or dye may be employed as the colorant for the toner particles. Toner colorants are well-known and include, for example, carbon black, nigrosine dye, aniline blue, Calco Oil Blue, chrome yellow, ultramarine blue, duPont Oil Red, Quinoline Yellow, methylene blue chloride, phthalocyanine blue, Malachite Green Oxalate, lamp black, Rose Bengal and mixtures thereof. The pigment or dye should be present in the toner in a quantity sufficient to render it highly colored so that it will form a clearly visible image on a recording member. Thus, for example, where conventional electrostatographic copies of typed documents are desired, the toner may comprise a black pigment such as carbon black, for example, furnace black or channel black, or a black dye such as Amaplast Black dye, available from the National Aniline Products, Inc. Generally, the pigment is employed in an amount from about 1% to about 20% by weight based on the total weight of the colored toner. If the toner colorant employed is a dye, substantially smaller quantities of colorant may be used. However, since a number of the above pigments used in electrostatographic toner may affect both the glass transition and fusion temperatures of the toner of this invention, their concentration preferably should be less than about 10% by weight of the colored toner. Representative patents in which toner and developer materials are disclosed include U.S. Pat. Nos. 2,788,288, 3,079,342, 3,577,345, 3,653,893, 3,590.000, 3,655,374, 3,720,617, and 3,819,367, and U.S. Re Pat. No. 25,136. Especially preferred for use in the present invention are those compositions disclosed in U.S. Re. Pat. No. 25,136 and U.S. Pat. No. 3,079,342 containing a copolymer of styrene and alkyl methacrylate; the compositions disclosed in U.S Pat. No. 3,590,000 comprising a solid, stable hydropholic metal salt of a fatty acid such as zinc stearate, and a polymeric esterification product of a dicarboxylic acid and a diol comprising a diphenol; and the compositions disclosed in U.S. Pat. No. 3,819,367 containing a minor proportion of submicroscopic silicon dioxide additive particles.

The toner may be prepared by a well-known toner mixing and comminution technique. For example, the ingredients may be thoroughly mixed by blending, mixing and milling the components and thereafter micropulverizing the resulting mixture. Another well-known technique for forming toner particles is to spray-dry a ball-milled toner composition comprising a colorant, a resin, and a solvent.

As long as a fatty acid bisamide is used as an external additive component in the toner composition, hard inorganic fine powders can be present in the toner composition without occurrence of the above problems.

The inorganic fine powders that may be used in conjunction with fatty acid bisamides as additives to the toner include those known as useful in this technology, such as silica, alumina, titania, zirconia, magnesia or fine resin powders.

Carriers which can be used with the toner composition to constitute a two-component type developer can be known iron powders, ferrite powders and those coated with various resins such as an acryle type, pyridine type, a pyrrolidone type or a fluorine type. A carrier comprising magnetic powders fixed with a suitable binder can also be used, if desired.

In more detail, any suitable coated or uncoated electrostatographic carrier bead material may be employed as the carrier material of this invention. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass and silicon dioxide. Typical magnetic brush development process carriers include nickel, steel, iron, ferrites, and the like, and are preferred. The carriers may be employed with or without a coating. Many of the foregoing and other typical carriers are described by L. E. Walkup et al in U.S. Pat. No. 2,638,416 and E. N. Wise in U.S. Pat. No. 2,618,552. Additionally, it is preferred that the carrier materials have semi-conductive to conductive properties. Where desired, the carrier materials may be coated with any suitable insulating material. Typical electrostatographic carrier particle coating materials include vinyl chloride-vinyl acetate copolymers, styrene-acrylate-organosilicon terpolymers, natural resins such as caoutchouc, colophony, copal, dammar, jalap, storax; thermoplastic resins including the polyolefins such as polyethylene, polypropylene, chlorinated polyethylene, and chlorosulfonated polyethylene; polyvinyls and polyvinylidenes such as polystyrene, polymethylstyrene, polymethyl methacrylate, polyacrylonitrile, polyvinyl acetate, polyvinyl alcohol, polyvinyl butyral, polyvinyl chloride, polyvinyl carbazole, polyvinyl ethers, and polyvinyl ketones; fluorocarbons such as polytetrafluoroethylene, polyvinyl fluoride, polyvinylidene fluoride; and polychlorotrifluoroethylene; polyamdies such as polycaprolactam and polyhexamethylene adipamide; polyesters such as polyethylene terephthalate; polyurethanes; polysulfides, polycarbonates, thermosetting resins including phenolic resins such as phenol-formaldehyde, phenol-furfural and resorcinol formaldehyde; amino resins such as urea-formaldehyde and melamine-formaldehyde; polyester resins; epoxy resins; and the like. Many of the foregoing and other typical carrier coating materials are described by L. E. Walkup in U.S. Pat. No. 2,618,551; B. B. Jacknow et al. in U.S. Pat. No. 3,526,433; and R. J. Hagenbach et al. in U.S. Pat. Nos. 3,533,835 and 3,658,500.

When the carrier materials of this invention are coated, any suitable electrostatographic carrier coating thickness may be employed. However, a carrier coating having a thickness of at least sufficient to form a thin film on the carrier particle is preferred because the carrier coating will then possess sufficient thickness to resist abrasion and prevent pinholes which adversely affect the triboelectric properties of the coated carrier particles. Generally, for cascade and magnetic brush development, the carrier coating may comprise from about 0.1% to about 10.0% by weight based on the weight of the coated carrier particles. Preferably, the carrier coating should comprise from about 0.3% to about 1.5% by weight based on the weight of the coated carrier particles because maximum durability, toner impaction resistance, and copy quality are achieved. To achieve further variation in the properties of the coated composite carrier particles, well-known additives such as plasticizers, reactive and non-reactive polymers dyes, pigments, wetting agents and mixtures thereof may be mixed with the coating materials and the coating may be continuous or discontinuous.

The photoreceptor having organic substances on the surface thereof which is suitable for using the dry toner composition of the present invention has a surface layer containing organic substances. The underlayer may comprise organic or inorganic substances. That is, as long as the surface coating layer is mainly composed of organic substances, the charge transport layer and/or the charge generating layer may be a selenium type material or $\alpha$-selenium type material. The term "mainly composed of organic substances" means that the surface coating layer may be composed of only organic materials, and also may be composed of a combination organic materials and inorganic materials which are included to improve the characteristics of the surface layer.

The main component of the surface layer of the photoreceptor is a resin conventionally used in this technology, such as polyamide, polyurethane, polyester, epoxy, polyvinyl ketone, polycarbonate, polystyrene, poly-N-vinylcarbazole or polyacrylamide type resins.

Any suitable organic or inorganic photoconductive material may be employed in the photoreceptor. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfo-selenide and mixtures thereof.

Typical organic photoconductors include: quinacridone pigments, phthalocyanine pigments, triphenylamine, 2,4-bis(4,4'-diethylamino-phenol)-1,3,4-oxadiazol, N-isopropylcarbazole, triphenylpyrrole, 4,5-diphenylimidazolidinone, 4,5-diphenyl-imidazolidinethione, 4,5-bis(4'-aminophenyl)imidazolidinone, 1,5-dicyanonaphthalene, 1,4-dicyanonaphthalene, aminophthalodinitrile, nitrophthalodinitrile, 1,2,5,6-tetraazacyclooctatetracene-(2,4,6,8), 2-mercaptobenzothiazole-2-phenyl-4-bisphenylideneoxazolone, 6-hydroxy-2,3-di(p-methoxyphenyl)benzofurane, 4-dimethylaminobenzylidene-benzhydrazide, 3-benzylideneaminocarbazole, polyvinyl carbazole, (2-nitrobenzylidene)-p-bromoanile, 2,4-diphenylquinazoline, 1,2,4-triazine, 5-diphenyl-3-methyl-pyrazoline, 2-(4'-dimethylaminophenyl)benzoxazole, 3-aminocarbazole, and mixtures thereof. Other organic photoconductors as disclosed in U.S. Pat. Nos. 4,562,132, 4,559,286, 4,557,989, 4,552,822, 4,555,822 and 4,555,463 may also be employed.

Suitable known methods of cleaning the photoreceptor which prominently exhibit the excellent effects of the toner composition of the present invention include a blade cleaning method, a brush cleaning method, a wed cleaning method, a magbrush cleaning method and the like.

EXAMPLE 1

| | |
|---|---|
| Styrene-acryle resin (number average molecular weight (Mn) 5,000, weight average molecular weight (Mw) 50,000) | 89 parts by weight |
| Nigrosine dye ("Bontron No. 3", manufactured by Orient Chemical Co., Ltd.) | 1 part by weight |
| Carbon black ("BPL", manufactured by Cabot Co., Ltd.) | 10 parts by weight |

The components described above were mixed, kneaded and pulverized to obtain toners having an average particle size of 11 μm (designated toner A). 0.3 wt% of methylene bisstearic acid amide manufactured by Nippon Chemical Co., Ltd. was added to toner A, followed by mixing using a V-type mixing device (designated toner composition B). Toner A and toner composition B each was mixed with ferrite powders having an average particle diameter of 70 μm to obtain a two-component type developer.

A photoreceptor having a charge generating layer composed of Chlorodian Blue and polymethyl methacrylate and a surface layer of a charge transport layer composed of the compound having the following formula and polycarbonate ("Punlight K1300", manufactured by Teijin Limited) was used.

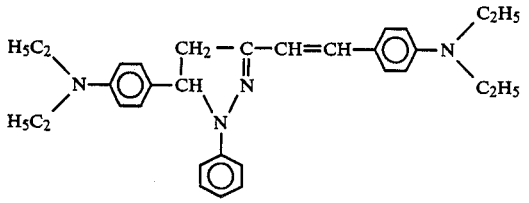

Many image copies were duplicated by a machine ("FX3500" manufactured by Fuji Xerox Co., Ltd.) to evaluate the resulting image qualities over time. A blade cleaning method using a polyurethane material was conducted.

In the test using toner A, deterioration of image qualities was observed after 5,000 copies due to poor cleaning ability, and black spots were observed after 12,000 copies. On the other hand, in the test using toner composition B, deterioration of image qualities was not observed at all, even after duplicating 50,000 copies due to stably effective cleaning.

EXAMPLE 2

| | |
|---|---|
| Styrene-acryly resin (Mn, 5,000, Mw, 10,000) | 90 parts by weight |
| Carbon Black ("BPL") | 10 parts by weight |

The components described above were mixed, kneaded and pulverized to obtain toners having an average particle size of 11 μm, to which 0.4 wt% of silica fine powder ("R972" manufactured by Degusa Co.) was added, followed by mixing using a V-type mixing device (designated toner composition C). 0.2 wt%, based on the weight of the toners of ethylene bisstearic acid amide manufactured by Lion Co. to toner composition C, followed by mixing using a V-type mixing device (designated toner compositon D). Toner compositions C and D each was mixed with polymethyl methacrylte-coated iron powders having an average particle diameter of 100 μm to obtain a two-component type developer.

Using the thus prepared developer, the same test as in Example 1 was repeated except that reversal development was carried out. In the test using toner composition C, black spots were observed after 2,000 copies. On the other hand, no deterioration of image qualities was observed with toner composition D, even after duplicating 50,000 copies.

EXAMPLE 3

| | |
|---|---|
| Styrene-acryle resin (Mn, 5,000, Mw, 10,000) | 90 parts by weight |
| Carbon black ("BPL") | 5 parts by weight |

The components described above were mixed, kneaded and pulverized to obtain toners having an average particle size of 10 μm, to which 0.5 wt. % of titanium oxide fine powder ("P25" manufactured by Degusa Co.) was added, followed by mixing using a V-type mixing device (designated toner composition E). 0.3 wt. %, based on the weight of the toners, of ethylene bislauric acid amide manufactured by Nippon Chemical Co. Ltd., to toner composition E, followed by mixing using a V-type mixing device (designated toner composition F). Toner compositions E and F each was mixed with polyvinylidene fluoride-hexafluoropropylene copolymer-coated ferrite powders having an average particle diameter of 90 μm to obtain a two-component type developer.

Using the thus prepared developer, the same test as in Example 1 was repeated. In the test using toner composition E, deterioration of image qualities due to poor cleaning ability and black spots were observed after 2,500 copies. On the other hand, in the test toner composition F, deterioration of image qualities was not observed at all, even after duplicating 50,000 copies due to stably effective cleaning.

The present invention provides a toner composition for a two-component type developer using a fatty acid bisamide compound as an external additive component. By using the toner composition of the present invention, excellent effects can be obtained in that toners hardly adhere on a photoreceptor having a surface layer mainly composed of organic substances, uniform and effective- cleaning can constantly be conducted, the photoreceptor is hardly deteriorated and excellent image qualities can be thus obtained over a long period of time.

While the invention has been described in detail and with reference to specific embodiments thereof, it will be apparent to one skilled in the art that various changes and modifications can be made therein without departing from the spirit and scope thereof.

What is claimed is:

1. A developer composition for developing an electrostatically charged image formed on a photoreceptor having a surface layer comprising an organic substance, the developer composition comprises (i) carrier particles, (ii) toner particles, (iii) an inorganic fine powder as an external additive selected from the group consisting of silica, alumina, titania, zirconia and magnesia and (iv) a fatty acid bisamide compound as an external additive which is present in an amount of from 0.05 to 0.05% by weight based on said toner particle.

2. A toner composition as in claim 1, wherein the fatty acid bisamide is a saturated fatty acid bisamide, an unsaturated fatty acid bisamide or an aromatic fatty acid bisamide.

3. A toner composition as in claim 2, wherein the fatty acid bisamide is selected from the group consisting of ethylenebisoleic acid amide, ethylene bisbehenic acid amide, ethylene bisstearic acid amide, ethylene bislauric acid amide, methylene bisstearic acid amide, hexamethylene bisoleic acid amide, butylene bisstearic acid amide, hexamethylene bisstearic acid amide, N,N'-di-oleylsebacic acid amide, N,N'-dioleyladipic acid amide, N,N'-disstearyl sebacic acid amide, N,N'-disstearyl adipic acid amide, m-xylene bisstearic acid amide, N,N'-distearyl isophthalic acid amide, and N,N'-distearyl terephthalic acid amide.

4. A toner composition as in claim 2, wherein the fatty acid bisamide is selected tom the group consisting of ethylenebisoleic acid amide, ethylene bisbehenic acid amide, ethylene bisstearic acid amide, ethylene bislauric acid amide, methylene bisstearic acid amide, hexamethylene bisoleic acid amide, butylene bisstearic acid amide, and hexamethylene bisstearic acid amide.

5. A process for developing an electrostatically charged image formed on a photoreceptor having a surface layer comprising an organic substance using a developer composition which comprises (i) carrier particles (ii) toner particles (iii) an inorganic fine powder as an external additive selected from the group consisting of silica, alumina, titania, zirconia and magnesia, and (iv) a fatty acid bisamide compound as an external additive which is present in an amount of from 0.05 to 0.5% by weight based on said toner particle.

* * * * *